United States Patent [19]

Johnson et al.

[11] 4,265,052

[45] May 5, 1981

[54] STORM WINDOW CONSTRUCTION

[76] Inventors: Earl L. Johnson, 2827 E. Little Cottonwood Rd., Salt Lake City, Utah 84170; Dell R. Beynon, Jr., #15 Altawood Dr., Sandy, Utah 84070

[21] Appl. No.: 67,543

[22] Filed: Aug. 17, 1979

[51] Int. Cl.[3] ..... E05B 65/04

[52] U.S. Cl. ..... 49/63; 49/404; 49/501; 49/504; 49/440

[58] Field of Search ..... 49/61, 62, 63, 404, 49/408, 413, 428, 453, 501, 504, 506, 507, 440; 52/743, 211

[56] References Cited

U.S. PATENT DOCUMENTS

| | | | |
|---|---|---|---|
| 2,736,930 | 3/1956 | Longley | 52/211 |
| 2,859,493 | 11/1958 | Matschke | 49/413 X |
| 3,375,627 | 4/1968 | Bursiek et al. | 52/743 X |
| 3,419,933 | 1/1969 | Gossen | 49/413 X |
| 3,858,356 | 1/1975 | Gross | 49/413 |
| 3,861,444 | 1/1975 | Portwood | 49/404 X |
| 3,890,754 | 6/1975 | Spurdle | 52/211 X |

*Primary Examiner*—Kenneth Downey
*Attorney, Agent, or Firm*—M. Ralph Shaffer

[57] ABSTRACT

A double window construction and particularly an interior storm window construction wherein the framing or frame of the storm window is uniquely configured to provide both window support for the storm windows installed and also a smooth interior finish relative to the window opening being accommodated. The windows themselves are chamfered at their outer edges to provide for ease of installation in tracks or channels formed by resilient ribs. The sides of each rectangular storm window, as to the frame, are generally L-configured in transverse cross-section and include outwardly facing support ribs for providing support as well as space to receive a settable fluid substance such as silicone rubber, whereby to provide a secure support for the frame. The inner edges of the frame sides are preferably cut at the job site to abut directly the interior surface of the existing window frame.

10 Claims, 5 Drawing Figures

STORM WINDOW CONSTRUCTION

The present invention relates to storm windows and, more particularly, to a storm window or double window construction wherein the added window is interior of, rather than exterior to the installed window.

DESCRIPTION OF PRIOR ART

In the past, storm windows have almost always been installed exterior to the existing window. Such storm windows are rather cumbersome to handle and install and, in any event, are undesirable when the user needs to install the windows in winter or inclement weather. Clearly, it would be much preferred if, in existing window installations, the storm window, a term simply used to describe the added window, is installed interior of the existing window rather than at the exterior portion of the house or building.

Certain attempts have been made to install an interior window, but generally without the rigidity or satisfaction in construction and installation than that which would be desired. No patents are known, either domestic or foreign which bear upon the invention as described and claimed.

BRIEF DESCRIPTION OF THE INVENTION

According to the present invention the interior storm window construction takes the form of a four-sided rectangular frame, each side of which has a transverse cross section defined by two 90° related flanges. The outer flange forms essentially a casement flange or member that can be glued or nailed in place, with the sides being mitered or otherwise formed at their ends for flush installation relative to the remaining side members.

The inner flanges, which are horizontal as to the top and bottom members are provided with inwardly directed channel forming ribs that receive suitably formed windows. The ribs are preferably resilient and also slightly compressible so as to provide for ease of window installation. The outer edges of the individual window construction are chamfered to provide for ease of insertion of the windows in the channels provided.

Also provided are essentially outwardly directed support ribs which engage or are at least oriented toward the sides of the window opening. In installation, the inner window sill is simply chiseled out or otherwise removed and the support ribs simply rest upon the upper surface of the sill grout or mortar. Preferably there will be provided holes in the inner flanges of the window frame members between the support ribs so that a settable fluid or liquid substance can be introduced through the holes to position, e.g., silicone rubber in the space between the support ribs and between the associated flange and sill mortar. This is allowed to set up so as to provide further rigidity to the structure.

Importantly, on the job there will be provided an edge to be cut to dimension so that such edge will abut directly upon the edge of the previously installed normal window frame.

OBJECTS

Accordingly, a principal object of the present invention is to provide a new type of double window construction.

A further object is to provide an auxiliary window construction and installation which will take the place of the usual, outwardly installed storm window customarily supplied dwellings, office buildings and the like.

A further object is to provide a new and improved, interior storm window construction.

A further object is to provide an interior storm window construction, the members of which can be cut on the job to fit exactly and abut the installed outer window of the dwelling, for example.

A further object is to provide a storm window construction wherein channel forming ribs are made resilient, for general compression sealing of installed windows themselves.

A further object is to provide support means for an interior storm window construction.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
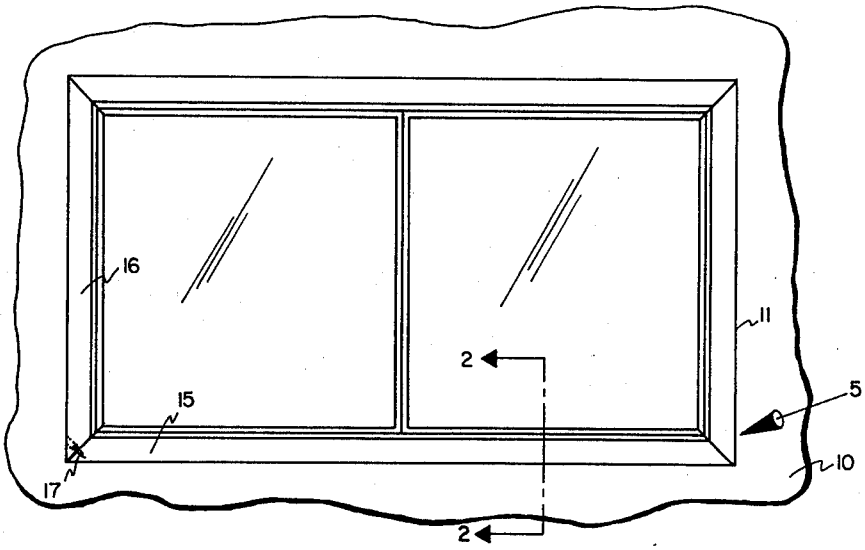
FIG. 1 is a view from the interior of a dwelling looking outwardly of a window construction incorporating the features of the present invention.

In FIG. 1 an enclosure 10 such as a room includes a window installation at 11. The latter includes the conventional window frame 12, the windows themselves being not shown for purposes of clarify, and also a storm window structure 13. The latter includes a storm window frame 14 having a series of frame members 15 and 16 that are joined together at their mitered ends by screw 17, for example. Optionally, finishing nails or other attachments at 18 may be employed simply to secure the various members 15 and 16 in place such that their mitered ends abut. The window installation of course is fitted into an opening 19 which is formed in part by a series of studs 20, one being shown, topped by a horizontal member or header as at 21. Interior and exterior panels 22 and 23 are implaced in the usual manner. The exterior includes masonry elements such as masonry blocks or bricks at 24 that are separated by and joined together by mortar joints 25 in a conventional manner. Sill 26 is installed in the usual way and includes a sealing mortar or grout or other means as at 27 for sealing purposes.

Figure 2:
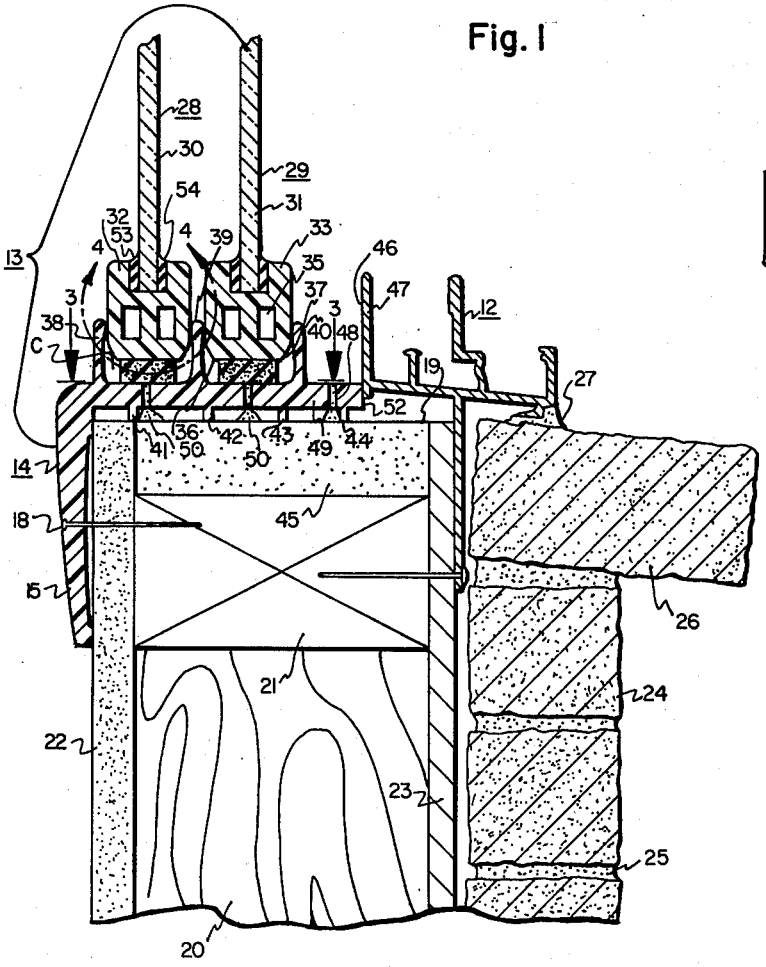
FIG. 2 is a vertical transverse section taken alone the line 2—2 in FIG. 1 and is typical of all sides of the window construction as to the configuration thereof and its installation.
Figure 3:
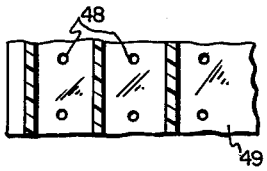
FIG. 3 is a fragmentary plan view of a representative frame member of the storm window construction showing the apertures or holes provided to receive silicone rubber or another suitable substance for support or filler purposes.
Figure 5:
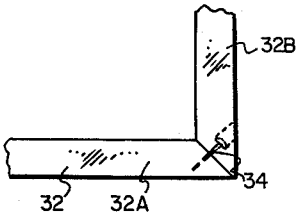
FIG. 5 is a fragmentary view taken along the arrow 5 in FIG. 1.

Considering the storm window structure 13, the same includes window members 28 and 29 which include the window panes 30 and 31 surrounded by frame 32 and 33. The frames 32 and 33 may comprise a series of frame elements 32A, 32B, etc., which are joined together by screws 34 that are suitably countersunk and disposed as seen in FIG. 5. Openings 35 are for purposes of lightening. It is noted that the frames are chamfered at opposite lower edges as at 36 and 37 for purposes of frame insertion between the several upstanding fins or flanges 38, 39 and 40, for example. Such flanges form the integral parts of the respective frame members and define channels for receiving the storm windows as seen in FIG. 2.

Each of the frame members at 15 likewise include depending fins 41—44 which rest upon sill mortar 45 that remains after the worker removes the customary sill that abuts side 46 of flange 47. A series of holes as at 48 are supplied in the horizontal portion 49 of FIG. 2 so as to accommodate the insertion of a flowable silicone rubber 50. This tends to set in a semi-plastic state so as to essentially secure the horizontal appropriate configurement of the horizontal portion 49 of frame member 15. This is especially suitable where the lower edges of ribs 41–44 do not touch the upper surface of the grout or where the grout for the previously installed sill is irregular in upper surface configuration.

Figure 4:
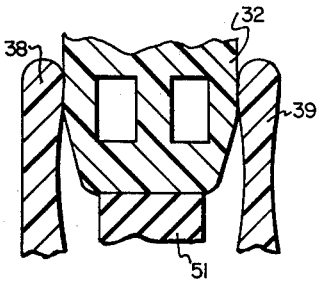
FIG. 4 is an enlarged fragmentary detail, shown in section, and taken along the line 4—4 in FIG. 2.

For convenience and ease of sliding, a series of slide strips 51 as seen in FIG. 4 are installed beneath the two storm windows so as to provide for a smooth surface and hence easy sliding of the windows 28 and 29.

It is to be noted in installation that edge 52 is cut on the job to fit against the surface 46 in an exact configurement.

In installation and operation, the storm window construction is installed as is indicated in FIG. 2, again the storm window frame elements being cut on the job so that the various edges 52 of the storm window will exactly abut surface 46 of the installed regular window frame at 12. The entire preferably extruded frame members of the storm window installation are installed as seen in FIG. 1 with the respected ends of the frame members being mitered appropriately. It is noted that the window is encompassed by the storm window frame members of identical cross section to that seen in FIG. 2, in a preferred form of the invention.

Once the frame members are installed as by the finishing nails 18, by way of example, then it is a simple matter to insert the slide strips as at 51 and, subsequently, to install the storm windows. In this regard, the upper frame member will have a sufficient depth so that the windows can be lifted upwardly and then nestled downwardly between the flanges 38–40 as indicated.

Preferably, the window frame members will be made of a medium density polyethylene or some other suitable plastic so as to provide a slight resiliency and even a slight compression of the various upstanding fins 38–40. This is to provide an easy and yet secure nesting of the frame members within the channels C as so formed.

Rubber inserts or other means as at 53 and 54 can be employed to further secure the window panes 30 and 31 in place as seen in FIG. 2.

It is seen that the above construction comprises an interior installation of a storm window structure which ideally serves in adding further insulated qualities in the wall in which the window is installed.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. An interior storm window construction including, in combination, a four-sided frame each side of which has a generally L-shaped transverse cross-section and is provided with a plurality of inwardly directed channel-forming ribs defining window-receiving channels and outwardly directed support ribs, said frame being provided with respective sets of fluid-admitting apertures between successive pairs of said support ribs, windows disposed in said channels, said frame being provided with an on-the-job-site-cut, installed-window-frame abutment edge disposed inwardly of said channel-forming ribs.

2. The structure of claim 1 wherein said sides of said frame are of extruded plastic providing resiliency to said channel-forming ribs.

3. The structure of claim 1 wherein a settable fluid media is disposed into and through said apertures of said sets.

4. The structure of claim 2 wherein said windows have chamfered outer edges.

5. In combination, structure forming a window opening, an outer window frame installed at said opening, and in inner window frame installed at said opening inwardly of said outer window frame, said inner window frame comprising four sides forming a rectangle, each of said sides comprising an inner flange and an outer casement flange integral therewith in essentially 90° relationship, said inner flange having inwardly directed mutually spaced ribs forming window-receiving channels and also outwardly projecting support ribs directed toward said opening, said inner flange also having a job-site-cut edge formed to abut said outer window frame, said window frames being constructed to receive windows.

6. The structure of claim 5 wherein said inner flange is provided with respective sets of apertures disposed between respective pairs of said support ribs.

7. The structure of claim 6 wherein said channel-forming ribs are resilient, whereby to sealingly grip windows placed in said channels.

8. The structure of claim 6 wherein a settable fluid substance is introduced within said apertures between said inner flange and said window-forming structure.

9. The structure of claim 1 wherein said frame includes slide strips disposed over respective ones of said sets of apertures as are present between said channel-forming ribs.

10. A window frame side extrusion comprising a pair of elongate, integral, 90°-related flanges, and plural sets of mutually spaced ribs means disposed on opposite sides of one of said flanges, said one flange being provided with respective sets of settable-fluid-receiving apertures disposed between opposite sets of said ribs.

* * * * *